US006276008B1

(12) United States Patent
Chen

(10) Patent No.: US 6,276,008 B1
(45) Date of Patent: Aug. 21, 2001

(54) HAMMOCK FRAME

(76) Inventor: Fu-Ching Chen, No. 529, Dou Yuan W. Road, Ho Hsin Tsun, Ba Tou Hsiang, Changhua Hsien (TW)

( * ) Notice: Subject to any disclaimer, the term of this patent is extended or adjusted under 35 U.S.C. 154(b) by 0 days.

(21) Appl. No.: 09/392,529

(22) Filed: Sep. 9, 1999

(51) Int. Cl.[7] ..... A45F 3/24
(52) U.S. Cl. ..... 5/127; 5/128; 5/120; 5/121
(58) Field of Search ..... 5/127, 128, 129, 5/130, 120, 121; 472/118, 125

(56) References Cited

U.S. PATENT DOCUMENTS 781,609 * 1/1905 Lawson ..... 5/127
1,229,537 * 7/1917 Sisbower et al. ..... 5/127

* cited by examiner

*Primary Examiner*—Lynne H. Browne
*Assistant Examiner*—Fredrick Conley
(74) *Attorney, Agent, or Firm*—Rosenberg Klein & Lee

(57) ABSTRACT

A hammock includes two parts each have a post and two connecting tubes extending radially outward from each post. Each post has two collapsible legs pivotally connected to one of two ends thereof and a tube connected to the other end of each post. Two beams composed of two sections are connected between the two pairs of the connecting tubes. A sun-shade is detachably connected between the two tubes of the posts. Each post has a hook so that a bed is connected between the two hooks.

6 Claims, 5 Drawing Sheets

HAMMOCK FRAME

FIELD OF THE INVENTION

The present invention relates to a frame for a hammock and the frame includes two identical parts each of which has a collapsible base and a post, two retractable beams connected between the two posts. Each post has a hook means so as to connect a bed therebetween.

BACKGROUND OF THE INVENTION

A conventional hammock generally comprises two U-shaped frames which are connected together by connecting two legs of each frame by bolts. The U-shaped frames each are angled so that when the two frames are connected together the two ends of the hammock are located above the ground so that a bed can be connected between the two ends. An inherent shortcoming of the conventional frame of the hammock is that it occupies too much space so that it is inconvenient for transportation and storage. Therefore, the user cannot take the hammock in his/her car if he/she wants to take other camping or barbecue equipment.

The present invention intends to provide an improved frame for a hammock wherein the frame can be assembled by two parts and two beams so that the user may transport or carry the hammock in a compact size. The hammock of the present invention can resolve the problems of the conventional hammock.

SUMMARY OF THE INVENTION

In accordance with one aspect of the present invention, there is provided a hammock and comprise two parts each having a post with a first connecting tube and a second connecting tube extending from two ends of each post. Each post has a groove defined longitudinally in the second end thereof and a hook is connected to each post. Two blocks are respectively mounted to the two posts and each block has two legs pivotally connected to two ends thereof. Each pair of legs are connected to the block and a plate is connected between the two legs. A bolt extends through each plate and is inserted into the groove in the post. Two beams are respectively and detachably connected between the first connecting tubes and between the second connecting tubes.

It is an object of the present invention to provide a hammock frame which can be dis-assembled into small parts so as to be convenient for storage and transportation.

Further objects, advantages, and features of the present invention will become apparent from the following detailed description with appropriate reference to the accompanying drawings.

DETAILED DESCRIPTION OF THE PREFERRED EMBODIMENT

Figure 1:
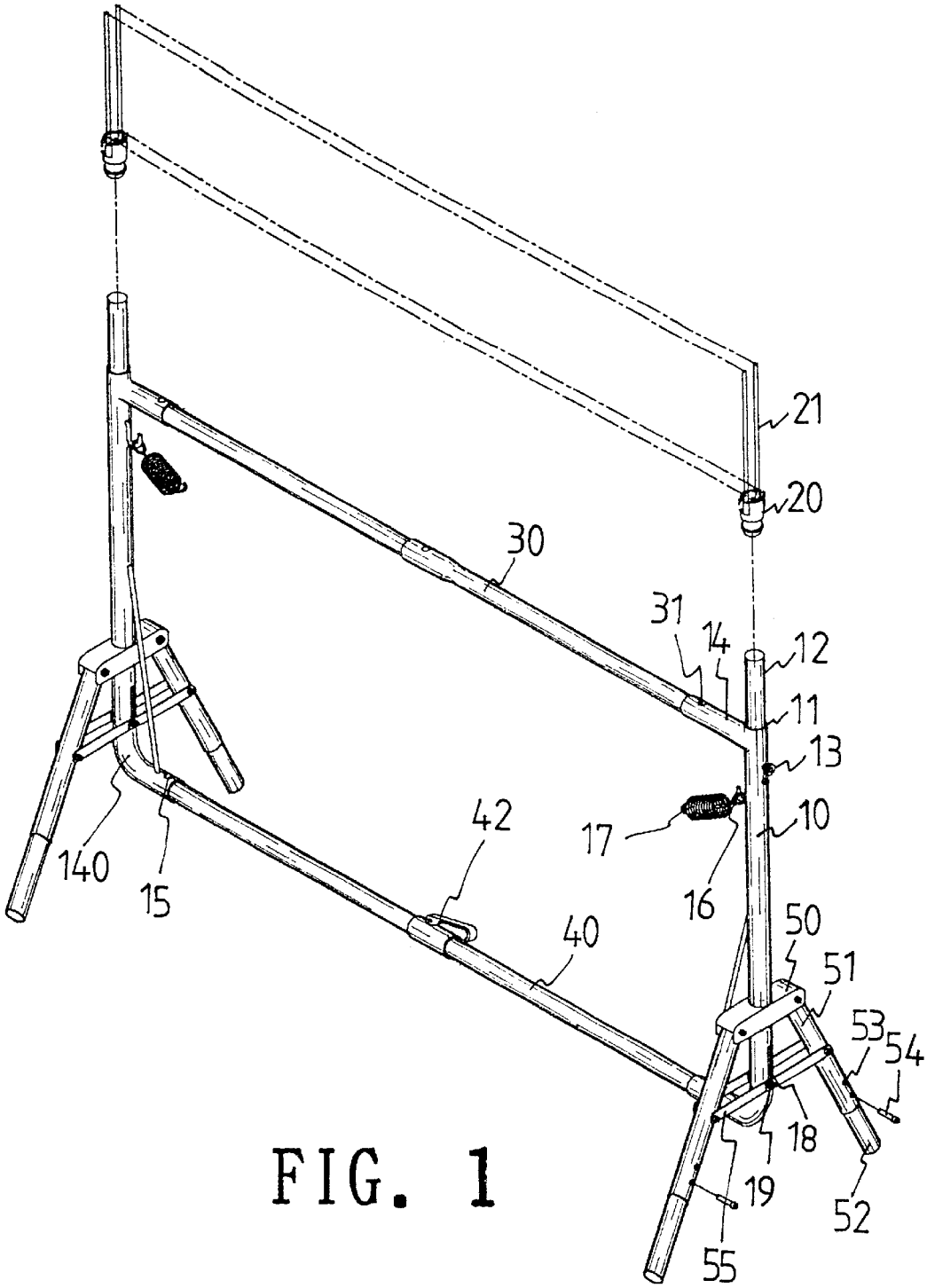
FIG. 1 is an exploded view to show the frame of the hammock and a sun-shade of the present invention.
Figure 2:
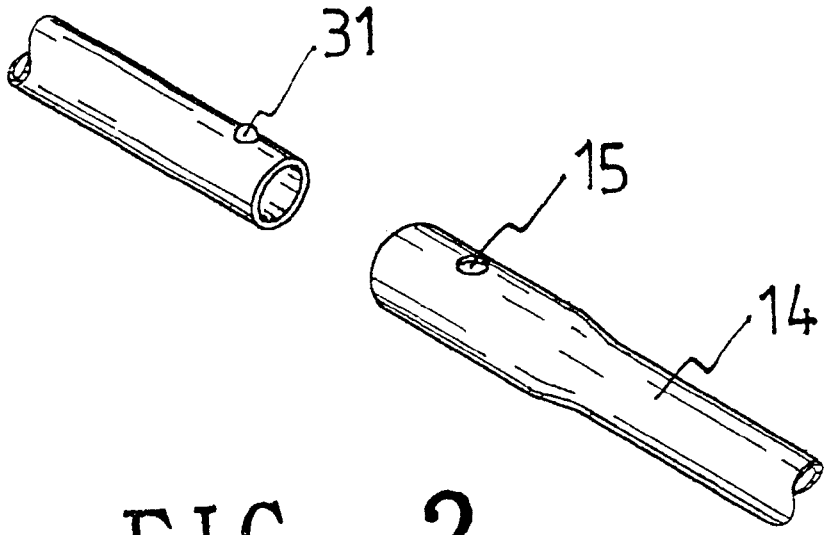
FIG. 2 is an illustrative view to show one of the two sections of the first beam and the first connecting tube on the post of the present invention.
Figure 3:
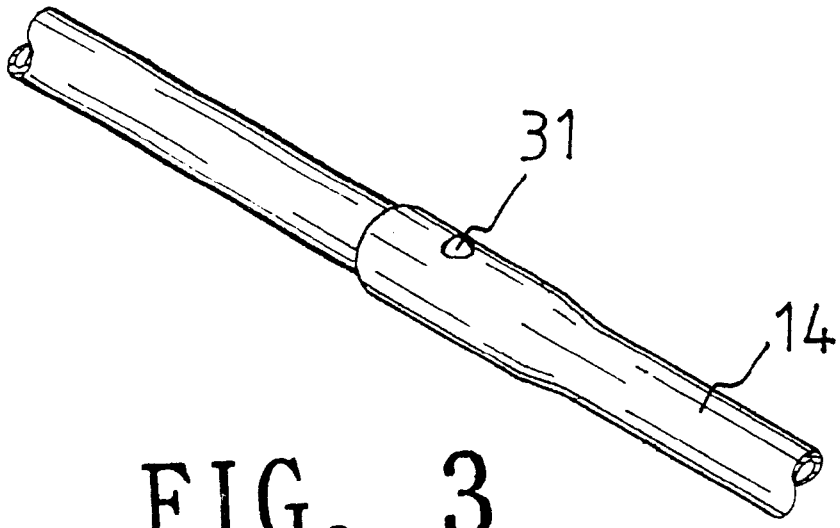
FIG. 3 is an illustrative view to show the combination of the section of the first beam and the first connecting tube as shown in FIG. 2.
Figure 8:
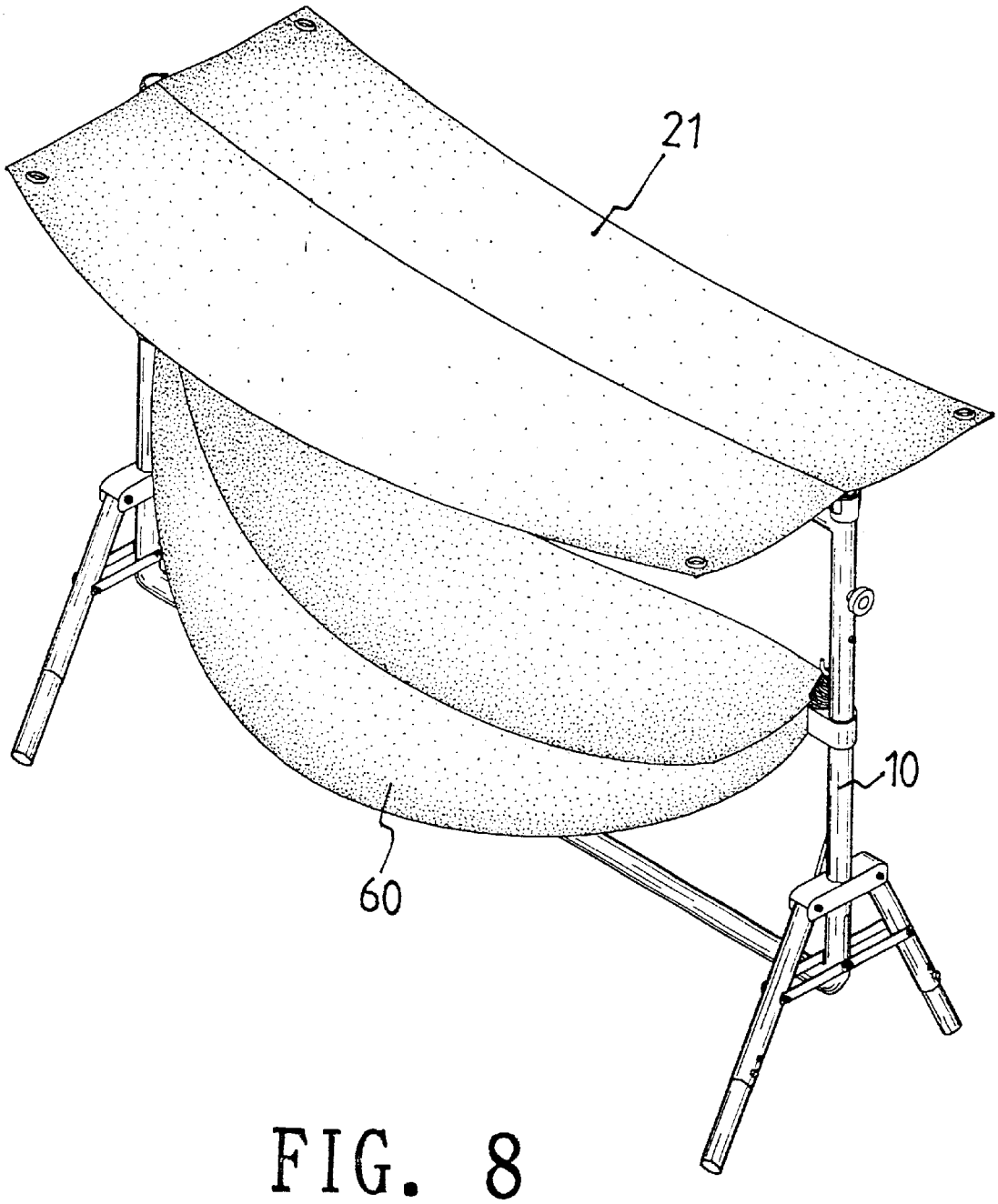
FIG. 8 is a perspective view of the hammock in accordance with the present invention.

Referring to FIGS. 1 to 3, a hammock in accordance with the present invention comprises two parts each having a post 10, a first connecting tube 14 extending radially from a first end of each post 10 and a second connecting tube 140 extending from a second end of each post 10. An open top 11 is defined in the first end of each post 10 and two grooves 18 are defined longitudinally in the second end of each post 10. Each post 10 has a hook 16 connected thereto and a spring 17 is connected to the hook 16 so that a bed 60 is connected between the two hooks 16 as shown in FIG. 8. A tube 12 is inserted into the open top 11 and a positioning bolt 13 extends through the post 10 and contacts against the tube 12 so that the tube 12 can be adjusted relative to the post 10. A sun-shade is connected between the two tubes 12 and has two insertions 20 which are inserted into the tubes 12. Each insertion 20 has two foldable shades 21 so that the two shades 21 can be expanded when in use.

Figure 6:
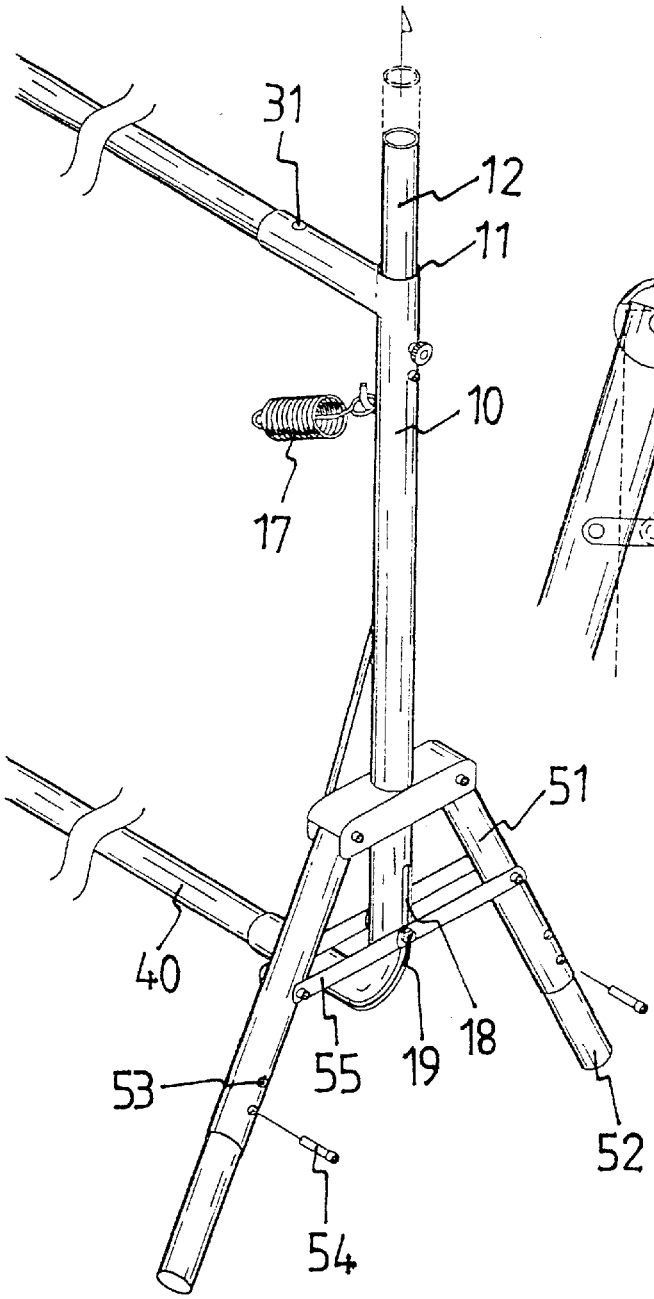
FIG. 6 is a perspective view to show one of the two posts with the collapsible legs connected thereto.
Figure 7:
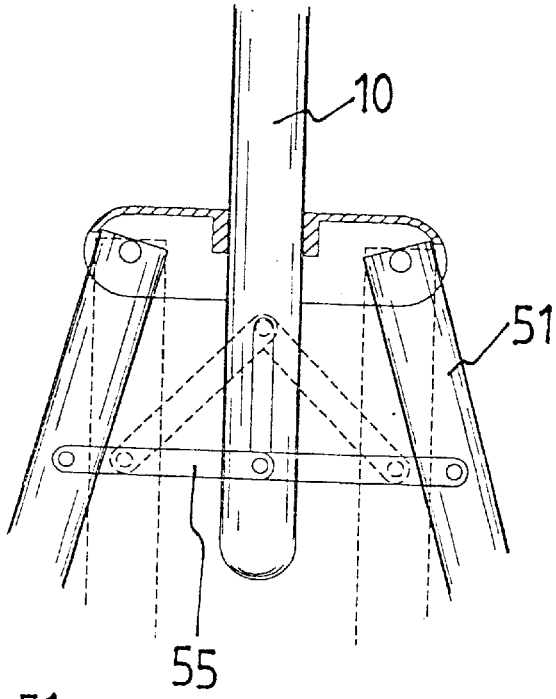
FIG. 7 is an illustrative view to show the movement of the two legs of FIG. 6.

Two blocks 50 are respectively mounted to the two posts 10 and each block 50 has two legs 51 pivotally connected to two ends thereof. Each pair of legs 51 are pivotally connected to the block 50 and a plate 55 is connected between the two legs 51. Two bolts 19 respectively extend through the plates 55 and are inserted into the grooves 18 in the post 10. Therefore, as shown in FIGS. 6 and 7, the two legs 51 can be collapsed toward the post 10 with the bolts 19 moved in the two grooves 18. Each of the two legs 51 further has an inner leg 52 which is retractably received in the leg 51 and a positioning bolt 54 extends through one of two holes 53 in the leg 51 and contacts against the inner leg 52.

The first connecting tubes 14 and the second connecting tubes 140 each have a hole 15 defined therethrough. The first beam 30 is composed of two sections, one of the two sections has two bosses 31 on tow ends thereof, and the other section has a boss 31 in one end and an aperture in the other end. The two sections of the first beam 30 are connected to the two first connecting tubes 14 by inserting the bosses 31 in the holes 15 of the first connecting tubes 14. The two sections of the first beam 30 are then connected with other by inserting the boss 31 in one section into the aperture in the other section.

Figure 4:
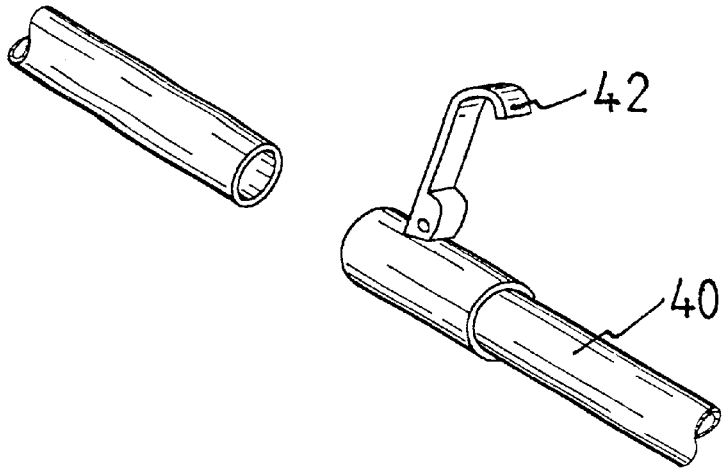
FIG. 4 is an illustrative view to show the two separated sections of the second beam of the frame of the present invention.
Figure 5:
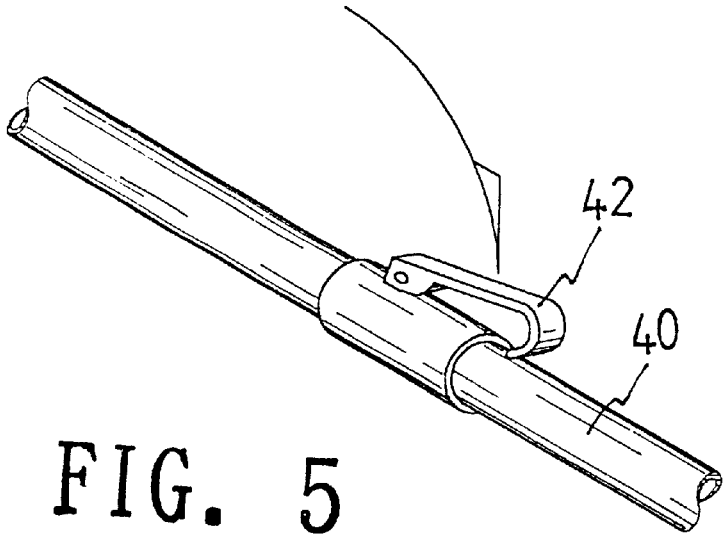
FIG. 5 is an illustrative view to show the second beam connected by the two sections of the present invention.

Referring to FIGS. 4 and 5, the second beam 40 is composed of two sections which are respectively connected to the two second connecting tubes 140 by the same way as that of the connection of the first connecting tubes 14 and the two sections of the first beam 30. One of the two sections of the second beam 40 has a cam means from which a lever 42 is connected, and the other section of the second beam 40 has an open end so that the open end is secured to the other section by the cam means.

Although the invention has been explained in relation to its preferred embodiment, it is to be understood that many other possible modifications and variations can be made without departing from the spirit and scope of the invention as hereinafter claimed.

What is claimed is:

1. A hammock comprising:

two parts each having a post, a first connecting tube extending radially from a first end of each post and a second connecting tube extending from a second end of each post, each post having a groove defined longitudinally in said second end thereof and each post having a hook connected thereto;

two blocks respectively mounted to said two posts and each block having two legs pivotally connected to two ends thereof, each pair of legs connected to said block and having a plate connected therebetween, a bolt extending through each plate and inserted into said groove in said post, and two beams respectively and detachably connected between said first connecting tubes, and between said second connecting tubes.

2. The hammock as claimed in claim 1, wherein at least one pair of said first connecting tubes and said second connecting tubes have a hole defined therethrough, at least one of said two beams has two bosses extending radially outward therefrom so as to be engaged with said holes.

3. The hammock as claimed on claim 1, wherein said second beam includes two sections which are connected to each other by a cam device.

4. The hammock as claimed on claim 3, wherein said cam device includes a lever.

5. The hammock as claimed in claim 1, wherein each post has an open top and a tube is inserted into said open top, a positioning bolt extending through said post and contacting against said tube.

6. The hammock as claimed in claim 5 further comprising a sun-shade which has two insertions and said insertions are inserted into said tubes.

* * * * *